US005328499A

United States Patent [19]

Poole et al.

[11] Patent Number: 5,328,499

[45] Date of Patent: Jul. 12, 1994

[54] MECHANICALLY ALLOYED NICKEL-BASE COMPOSITION HAVING IMPROVED HOT FORMABILITY CHARACTERISTICS

[75] Inventors: Jon M. Poole; Sarwan K. Mannan, both of Barboursville; Howard W. Sizek, Huntington, all of W. Va.

[73] Assignee: Inco Alloys International, Inc., Huntington, W. Va.

[21] Appl. No.: 54,517

[22] Filed: Apr. 28, 1993

[51] Int. Cl.[5] ..... C22C 30/00

[52] U.S. Cl. ..... 75/255; 65/374.12; 420/584.1; 420/586

[58] Field of Search ..... 75/252, 255, 234, 236; 428/551, 570; 420/445, 446, 449, 450, 586, 584.1; 148/410, 428, 419, 442; 65/374.12

[56] References Cited

U.S. PATENT DOCUMENTS

| | | | |
|---|---|---|---|
| 3,814,635 | 6/1974 | Cometto et al. | 148/11.5 R |
| 4,402,767 | 9/1983 | Hinze et al. | 148/11.5 P |
| 4,853,185 | 8/1989 | Rothman et al. | 420/584 |
| 4,877,435 | 10/1989 | Haeberle, Jr. et al. | 65/1 |

OTHER PUBLICATIONS

W. H. Couts, Jr., "Refractory Elements Effects on Workability", pp. 69–76, 1984 *ASM Conference on Refractory Alloying in Superalloys,* Rio deJaneiro, Brazil.

R. T. Holt and W. Wallace, "Impurities and Trace Elements in Nickel-Base Superalloys", pp. 1–24, *International Metals Review,* Mar. 1976.

Z. Meng and X. Xie, "The Strengthening Effect of Tantalum in Nickel-Base Superalloys", p. 5630572, *Superalloys 1984,* AIME, Oct. 7–11, 1984, Champion, Pa.

*Primary Examiner*—Richard O. Dean
*Assistant Examiner*—Margery S. Phipps
*Attorney, Agent, or Firm*—Edward A. Steen

[57] ABSTRACT

A mechanically alloyed composition of matter containing 30–40% chromium, 0–15% cobalt, 0–10% iron, 0.2–1.0% aluminum, 0.3–1.2% titanium, greater than 1–5% tantalum and/or niobium, 0.2–1% yttria, usual processing and trace impurities, and the balance nickel. The addition of tantalum improves the workability characteristics of the alloy. The alloy is particularly useful for molten glass spinners.

14 Claims, 1 Drawing Sheet

TEMPERATURE C°
816
871
927
982
1038
1093
1149
1204
1260
1316
TEMPERATURE F°
1500
1600
1700
1800
1900
2000
2100
2200
2300
2400
REDUCTION OF AREA, %
80
70
60
50
40
30
20
10
o - 2
□ - 4
◇ - 5
Δ - 6

MECHANICALLY ALLOYED NICKEL-BASE COMPOSITION HAVING IMPROVED HOT FORMABILITY CHARACTERISTICS

TECHNICAL FIELD

The instant invention relates to an oxide dispersion strengthened (ODS) alloy useful for glass spinners in general and, more particularly, to an alloy having improved hot workability characteristics.

BACKGROUND ART

There is a need for metallic materials that have useful strengths at temperatures in excess of 1090° C. (1994° F.). In ordinary usage, metallic materials operating at such temperatures are exposed to the deleterious effects of oxidation and sulfidation corrosion often in the presence of molten slag-like materials, for example molten silicate based slags and molten glass. In order to be practical, metallic materials operable at such temperatures must be hot workable so as to economically provide the shaped objects which are to be used.

U.S. Pat. No. 4,877,435, incorporated by reference, discloses a mechanically alloyed (MA) material with an approximate composition of 30–40% chromium, 5–25% cobalt, 0.5–10% iron, 0.2–0.6% aluminum, 0.3–1.2% titanium, 0.2–1% yttria and the balance nickel. Manganese may be present up to 2%, boron may be present to 0.05%, zirconium up to 0.4% and others (silicon, niobium, tantalum, molybdenum, tungsten, rhenium, hafnium, lanthanides and yttrium) up to about 1%. The consolidated and hot worked alloy has exceptional hot corrosion resistance and, when grain coarsened, good high (1093° C. [1994° F.]) temperature strength. Such an alloy is useful for the handling of molten glass.

Whereas this material can be hot formed to a plate product by conventional hot rolling, fabrication of molten glass spinners by hot spinning has been unsuccessful due to surface cracking and, in one instance, catastrophic brittle fracture. U.S. Pat. No. 4,877,435 states the alloy has excellent hot ductility if several conditions are met: (1) the carbon level is under 0.08% to minimize carbide precipitation, (2) the oxygen level should be less than 0.5% and best ductility is achieved when the oxygen is under 0.40%, (3) the weight percent titanium should be four times the weight percent nitrogen to insure the formation of innocuous titanium nitrides, and (4) the combined oxygen plus nitrogen level should be under 0.7%. Satisfying these conditions insures that the alloy has a 954° C. (1750° F.) high temperature tensile ductility over 40% which is an indicator of acceptable hot ductility. It is true that when these conditions are satisfied, the alloy does have a 954° C. tensile ductility over 40%. However, this does not translate into adequate hot ductility for the spin forming operations.

SUMMARY OF THE INVENTION

Accordingly, and in contrast to expectations with respect to ODS MA alloys, it has been found that a tantalum addition in the range of about 1–5% improves the high temperature ductility of U.S. Pat. No. 4,877,435. It is theorized that the tantalum promotes the formation of a stable and homogeneously distributed tantalum carbide in place of the embrittling grain boundary chromium carbide. Niobium may be substituted for tantalum. As a further improvement on U.S. Pat. No. 4,877,435, it has been observed that an iron addition promotes the formation of the grain boundary carbide which reduces the 1093° C. (2000° F.) stress rupture strength of the alloy. Further, a cobalt addition is not required as it appears to have little or no effect on the alloy's formability or molten glass corrosion resistance. Improvements in molten glass corrosion resistance is apparently primarily due to higher chromium levels.

BRIEF DESCRIPTION OF THE DRAWING

The FIGURE is a hot Gleeble ductility graph of a number of embodiments of the invention.

PREFERRED MODE FOR CARRYING OUT THE INVENTION

Figure 1:
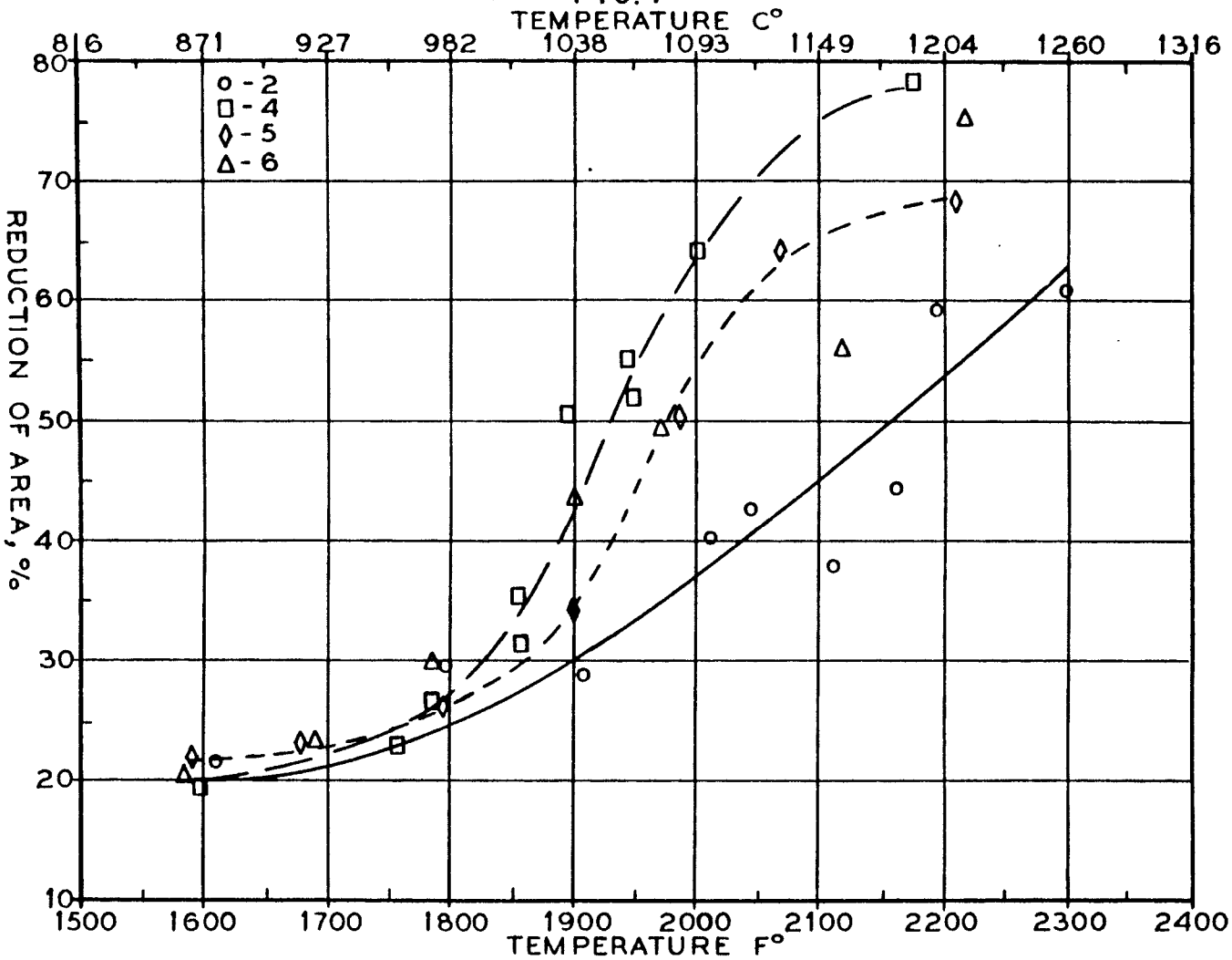

This present invention contemplates an alloy with improved formability for applications requiring contact with molten glass. The approximate alloy composition (in weight percent) is 30–40% chromium, 0–15% cobalt, 0–10% iron, 0.2–1.0% aluminum, 0.3–1.2% titanium, 1–5% tantalum, 0.2–1% yttria with the balance being nickel. Advantageously, the alloy may contain about 35–40% chromium, about 1.5–3.0% tantalum, about 0.4–0.8% aluminum, about 0.4–0.8% titanium, about 0.4–0.8% yttria, up to about 0.2% carbon, up to about 0.2% nitrogen, up to about 0.2% oxygen, under about 2% iron and under about 2% cobalt. Other potent carbide forming elements such as niobium (0–5%), zirconium (0–0.5%), hafnium (0–1%) and vanadium (0–1%) may also be present. Although it is preferred to incorporate tantalum in the alloy, it is possible to substitute niobium therefor. Accordingly, the combination of tantalum plus niobium in the range of at least about 1–5% may be used. Commercial and incidental impurities of manganese (2%), boron (0.05%), and 1% maximum of carbon, silicon, tungsten, rhenium, molybdenum and copper may also be present.

A number of experimental heats were formulated in order to determine the efficacy of the invention. These heats are given in Table 1.

TABLE I

| | Chemistry (wt. %) of ODS Ni—Cr—Co Alloys | | | | | | |
|---|---|---|---|---|---|---|---|
| | 1 | 2 | 3 | 4 | 5 | 6 | 7 |
| C | 0.05 | 0.04 | 0.04 | 0.10 | 0.04 | 0.05 | 0.06 |
| Fe | 6.5 | 4.24 | 2.90 | 3.67 | 2.59 | 3.55 | 3.45 |
| Ni | bal. | bal. | bal. | bal. | bal. | bal. | bal. |
| Cr | 36.0 | 33.3 | 35.3 | 33.2 | 34.7 | 34.8 | 35.0 |
| Al | 0.43 | 1.10 | 0.31 | 0.39 | 0.35 | 0.31 | 0.30 |
| Ti | 0.54 | 0.59 | 0.47 | 0.44 | 0.52 | 0.49 | 0.48 |
| Co | 12.9 | 12.6 | 14.8 | 14.3 | 14.8 | 6.9 | 2.6 |
| Ta | 0.0 | 0.0 | 0.0 | 1.3 | 0.9 | 0.4 | 0.0 |
| Yttria | 0.55 | 0.57 | 0.55 | 1.10 | 0.55 | 0.55 | 0.55 |
| N | 0.06 | 0.13 | 0.02 | 0.15 | 0.07 | 0.05 | 0.03 |
| O | 0.55 | 0.41 | 0.35 | 0.56 | 0.43 | 0.47 | 0.46 |

All metric values are converted from original English units. In the event of an error, the underlying English measurement controls.

The alloys described by the invention are manufactured by the mechanical alloying process as disclosed in U.S. Pat. Nos. 3,591,362; 3,776,704; 4,386,979; 4,668,312 and in many technical publications. After mechanical alloying, the alloy powder is encapsulated in a mild steel container, extruded (1037°–1148° C. [1900°–2100° F.], 6.4:1 minimum extrusion ratio and 2/sec minimum strain rate), then hot rolled at 1037°–1148° C. (1900°–2100° F.) to finished size (about 0.81–0.95 cm [0.32–0.375"] thick). Gleeble and tensile specimens (0.32 cm [0.125"] diameter with 1.27 cm (0.5") gauge length)

were prepared from the as rolled material with the testing orientation in the direction of hot rolling.

Detailed evaluations of material manufactured in accordance to U.S. Pat. No. 4,877,435 were performed to isolate the hot formability problem. Evaluation consisted of formability testing by controlled strain rate, high temperature tensile testing, Gleeble hot ductility testing (TABLE 2 and the FIGURE) and metallographic analysis.

The Figure summarizes the hot Gleeble ductility as function of testing temperature for four oxide dispersion strengthened Ni-Cr-Co heats (TABLE 1). Material for this program was extruded in a 8.8 cm (3.5") container to 1.9 cm×5.1 cm (0.75"×2")×length and then hot rolled at 1121° C. (2050° F.) to 0.952 cm×5.1 cm (0.375"×2")×length. Material was tested in the as rolled condition.

Table 2 below depicts Gleeble hot ductility of the material disclosed in U.S. Pat. No. 4,877,435 (Heat 1).

TABLE 2

Gleeble Hot Ductility Relative to Testing Speed of Heat 1

| Test Temperature | | Platen Velocity cm (inch)/sec 0.012 (0.04) | 1.01 (0.40) | 4.31 (1.70) |
|---|---|---|---|---|
| 982° C. (1800° F.) | Tensile Str. MPa (Ksi) | 74.5 (10.8) | 310 (45.0) | — — |
| | Reduction of Area % | 34.2 | 21.1 | |
| 1038° C. (1900° F.) | Tensile Str., MPa (Ksi) | 102 (14.8) | 255 (37.0) | 289 (41.9) |
| | Reduction of Area % | 49.4 | 26.4 | 19.1 |
| 1093° C. (2000° F.) | Tensile Str., MPa (Ksi) | — — | 134 (19.4) | — — |
| | Reduction of Area % | | 50.5 | |

Platen Velocity is related to but not equivalent to test strain rate.

Results of the formability tests clearly illustrate the excellent ductility of the U.S. Pat. No. 4,877,435 alloy (Heat 1) over a broad temperature range at low strain rates (under 0.76 mm/mm/sec. [0.03 inch/inch/sec.]) However, at larger strain rates the ductility dramatically falls: This is obvious from the ductility drop in high temperature tensile testing at 1066° C. (1950° F.) (0.76/mm/mm/sec., [0.03 inch/inch/sec.] strain rate), the poor 871°-1093° C. (1600°-2000° F.) Gleeble ductility (the FIGURE), and the drop in Gleeble ductility as a function of Gleeble platen speed (TABLE 2). (Test strain rate during Gleeble testing is related to the material ductility at temperature, and generally falls in the 51-762 mm/mm/sec. (2-30 in/in/sec.) range at a Gleeble platen velocity of 10.16 mm/sec [0.4 in/sec.]). Given that hot spinning is conducted in the 51-254 cm/sec. (2-10 in/sec.) strain rate range, it is not surprising to observe the formability problems of Heat 1.

To investigate the formability problem, transmission electron microscope (TEM) metallographic evaluations provided the following results: (a) the hot rolled material has a 0.25-0.75 μm equiaxed grain size, a 20-100 nm subgrain size and a high twin density, (b) the primary grain boundaries are partially or fully decorated with a thin precipitate which, on the basis of extraction analysis, is most likely chromium carbide ($Cr_{23}C_6$), (c) dislocations are present in an arranged and tangled configuration.

Based on these observations and forming studies some theories regarding the deformation of the Heat 1 alloy can be devised. At low strain rates and temperatures the material has excellent ductility. This exceptional ductility is probably due to grain boundary sliding, and forming conditions which permit grain rotation and restrict grain growth should provide excellent ductility (i.e., low strain rate, intermediate temperatures). At high strain rates and under 1093° C. (2000° F.), the material exhibits brittle failure due to microcracking at the grain boundary carbides accentuated by a localized stress concentration at the grain boundaries (i.e., dislocation pile-up) and lack of dynamic recrystallization (tangled dislocations). Above 1093° C. (2000° F.) the ductility is improved due to dynamic recrystallization. Further, a continuous grain boundary film is the worst case scenario for microcracking since it will restrict the grain rotation and grain boundary sliding. However, at higher temperatures the composition will have either clean or partially covered grain boundaries.

In summary, the hot spinning failures are due to forming in the low temperature (1010° C.[1850° F.]), high strain rate (circa 127 mm/mm/sec. [5 in/in/sec]) range where the material exhibits microcracking and brittle fracture. Unfortunately, increasing the spinning temperature or reducing the strain rate to a higher ductility regimen for the material is not possible given the current spinning technology. Further, a 954° C. (1750° F.) tensile test is not an appropriate indicator of hot forming behavior. A better test to evaluate hot ductility is the high strain rate Gleeble test.

Room and high temperature tensile results for the material with the composition in TABLE 2 are presented in TABLE 3. The Gleeble hot ductility results for these same materials is plotted in the Figure.

TABLE 3

High Temperature Tensile Results for ODS Ni—Cr—Co Alloys (Test Strain Rate 0.005/sec.)

| Heat No. | Test Temperature C.° (°F.) | Tensile Strength MPa (Ksi) | 0.2% Yield Strength MPa (Ksi) | Elongation % | Reduction in Area % |
|---|---|---|---|---|---|
| 4 | 25 (77) | 1600 (232.1) | 1600 (232.6) | 4.0. | 21.0 |
| | 954 (1750) | 51 (7.4) | 26.8 (3.9) | 50.0 | 45.0 |
| | 1010 (1850) | 29.6 (4.3) | 20.7 (3.0) | 26.0 | 43.0 |
| | 1093 (2000) | 16.5 (2.4) | 15.9 (2.3) | 26.0 | 42.0 |
| 5 | 25 (77) | 1360 (197.3) | 1295 (187.8) | 11.0 | 31.9 |
| | 954 (1750) | 55.2 (8.0) | 49.6 (7.2) | 84.0 | 82.3 |
| | 1010 (1850) | 47.6 (6.9) | 42.7 (6.2) | 81.0 | 85.5 |
| | 1093 (2000) | 22.8 (3.3) | 15.2 (2.2) | 84.0 | 88.8 |
| 6 | 954 (1750) | 71 (10.3) | 53 (7.7) | 65.2 | 79.2 |
| | 1010 (1850) | 44.9 (6.5) | 30.3 (4.4) | 58.0 | 83.4 |
| | 1093 (2000) | 27.6 (4.0) | 8.6 (2.7) | 50.6 | 76.6 |
| 7 | 25 (77) | 1289 (186.2) | 1174 (170.3) | 8.0. | 26.7 |
| | 954 (1750) | 46.2 (6.7) | 31 (4.5) | 78.2 | 78.9 |
| | 1010 (1850) | 31.7 (4.6) | 21.4 (3.1) | 72.6 | 77.7 |
| | 1093 (2000) | 22.8 (3.3) | 13.1 (1.9) | 52.0 | 68.6 |

It should be appreciated that the 954° C. (1750° F.) tensile data reported in U.S. Pat. No. 4,877,435 is in the same range as the data reported in TABLE 3. Hence the lower cobalt or tantalum addition has no impact on the slow strain rate ductility of the alloy. It should also be appreciated that the higher carbon, oxygen and nitrogen content of Heat 4 reduces the ductility (Table 3) of the alloy in accordance with the observations in U.S. Pat. No. 4,877,435. Considering the high strain rate Gleeble results (the FIGURE) it is rather apparent that the tantalum addition improves the hot ductility of the alloy. It is also noteworthy that the 1.3% tantalum heat has excellent hot ductility in spite of the high carbon, oxygen and nitrogen levels. Hence, improved hot formability can be realized with a tantalum addition in the greater than about 1-5% range or more preferably in the 1.5-3.0% range.

In a similar fashion, material having the composition shown in TABLE 4 was processed to 9.5 mm/50.8 mm (0.375"×2") bar by extrusion and hot rolling. After hot rolling, the bars were given a 1316° C. (2400° F.) one-hour grain coarsening anneal. Stress rupture samples were prepared and tested at 1093° C. (2000° F.) to determine the 100-hour rupture stress (TABLE 5). It is observed that increasing iron and chromium levels reduce the stress rupture strength of the material. Whereas chromium is desirable for glass corrosion resistance, the iron is not beneficial and a deliberate addition is not required.

TABLE 4

| | Chemistry (wt. %) of ODS Ni—Cr—Co Alloys | | | | |
|---|---|---|---|---|---|
| | 8 | 9 | 10 | 11 | 12 |
| C | 0.04 | 0.04 | — | 0.04 | 0.04 |
| Fe | 5.45 | 6.89 | 3.35 | 2.86 | 2.90 |
| Ni | Bal. | Bal. | Bal. | Bal. | Bal. |
| Cr | 35.6 | 34.92 | 38.4 | 36.55 | 35.28 |
| Al | 0.5 | 0.49 | 0.51 | 0.38 | 0.31 |
| Ti | 0.57 | 0.57 | 0.58 | 0.52 | 0.49 |
| Co | 15.0 | 14.8 | 14.9 | 14.9 | 14.8 |
| Ta | 0.0 | 0.0 | 0.0 | 0.0 | 0.0 |
| Yttria | 0.53 | 0.57 | 0.47 | 0.52 | 0.55 |
| N | 0.10 | 0.12 | 0.18 | 0.19 | 0.02 |
| O | 0.53 | 0.52 | 0.58 | 0.63 | 0.35 |

TABLE 5

| | 100-hour Rupture Strength of ODS Ni—Cr—Co alloys. | | | |
|---|---|---|---|---|
| | Heat No. 10 and 12 0-4% Fe | | Heat No. 8 and 9 Over 4% Fe | |
| % Cr | 1066° C. (1950° F.) | 1121° C. (2050° F.) | 1037° C. (1900 F.) | 1121° C. (2050° F.) |
| 36.5% | 95.8 MPa (13.9 ksi) | 115 MPa | 73.5 MPa (10.6 ksi) | 83.4 MPa (12.1 ksi) |
| | 84.8 MPa (12.3 ksi) | (16.7 ksi) | 63.4 MPa (9.2 ksi) | 57.9 MPa (8.4 ksi) |
| 38.5% | 82.4 MPa (11.8 ksi) | 84.8 MPa | — | — |
| | 89.8 MPa (12.3 ksi) | (12.3 ksi) | | |

All material annealed at 1316° C. (2400° F.)/1 hr. air cooled.

While in accordance with the provisions of the statute, there is illustrated and described herein specific embodiments of the invention, those skilled in the art will understand that changes may be made in the form of the invention covered by the claims and that certain features may sometimes be used to advantage without a corresponding use of the other features.

The embodiments of the invention in which an exclusive property or privilege is claimed are defined as follows:

1. A mechanically alloyed composition of matter consisting essentially of in weight percent about 30–40% chromium, up to about 15% cobalt, up to about 10% iron, about 0.2%–1.0% aluminum, about 0.3–1% titanium, a carbide former selected from the group consisting of tantalum and niobium in a range at least 1.3% to about 5%, about 0.2–1% yttria, up to about 0.5% zirconium, up to about 1% hafnium, up to about 1% vanadium up to about 2% manganese, up to about 0.05% boron, up to about 0.2% carbon, up to about 0.2% nitrogen, up to about 0.6% oxygen, up to about 1% of the group consisting of silicon, tungsten, rhenium, molybdenum and copper, standard trace commercial impurities, and the balance nickel.

2. The composition of matter according to claim 1 comprising at least 1.3% to about 5% tantalum.

3. The composition of matter according to claim 1 comprising at least 1.3% to about 5% niobium.

4. The composition of matter according to claim 1 comprising about 1.5–3% tantalum.

5. The composition of matter according to claim 1 comprising about 35–40% chromium, about 1.5–3% tantalum, about 0.4–0.8% aluminum, about 0.4–0.8% titanium, about 0.4–0.8% yttria, less than about 2% iron, less than about 2% cobalt, and the balance nickel.

6. The composition of matter according to claim 1 comprising about 33–34% chromium, about 6–15% cobalt, about 0.05–0.10% carbon, about 2–4% iron, about 0.3–0.4% aluminum, about 0.4–0.6% titanium, at least 1.3 to about 5% tantalum, about 0.5–2% yttria, about 0.05–0.02% nitrogen, about 0.4–0.6% oxygen and the balance nickel.

7. The composition of matter according to claim 1 wherein at least a portion of the titanium and carbon present in the alloy are in the form of titanium carbide.

8. The composite of matter according to claim 1 in the form of a glass spinner.

9. The composition of matter according to claim 1 wherein the composition exhibits a tensile strength on the order of about 16.5 to about 27.6 MPA in a temperature range of about 954° C. to about 1093° C.

10. The composition of matter according to claim 1 comprising about 0.1% carbon, about 3.7% iron, about 33.2% chromium, about 0.4% aluminum, about 0.4% titanium, about 14.3% cobalt, at least 1.3% tantalum, about 1.1% yttria, about 0.1% nitrogen, about 0.6% oxygen, and the balance nickel.

11. The composition according to claim 1 comprising about 37.5% chromium, about 2.25% tantalum, about 0.6% aluminum, about 0.6% titanium, about 0.6% yttria, less than about 2% iron, and less than 2% cobalt.

12. A mechanically alloyed composition of matter consisting essentially of in weight percent of about 30–40% chromium, about 5–25% cobalt, about 0.5–10% iron, about 0.2–0.6% aluminum, about 0.3–1.2% titanium, up to about 0.15% carbon, about 0.2–1% of yttria in a yttria-containing oxidic phase, up to about 0.7% oxygen inclusive of the oxygen in yttria, up to about 0.3% nitrogen with the proviso that the weight of said titanium is at least about 1.5 times the weight of nitrogen, up to about 0.4% zirconium, up to about 1% hafnium, up to about 1% silicon, up to about 2% manganese, up to about 0.05% boron, a carbide former selected from the group consisting of tantalum and niobium in a range at least 1.3% to about 5%, up to about 1% molybdenum, up to about 1% tungsten, up to about 1% rhenium, up to about 1% total yttrium and lanthanides provided that the total of hafnium, silicon, manganese, boron, niobium, tantalum, molybdenum, tungsten, rhenium, yttrium and the lanthanides does not exceed about 10%, the balance of the composition being essentially nickel.

13. The composition of matter according to claim 12 comprising about 1.5–3% tantalum.

14. The composition of matter according to claim 12 in the form of a glass spinner.

* * * * *